US006492602B2

(12) United States Patent
Asai et al.

(10) Patent No.: US 6,492,602 B2
(45) Date of Patent: Dec. 10, 2002

(54) TWO-POSITION PUSHBUTTON SWITCH

(75) Inventors: Akira Asai, Miyagi-ken (JP); Shigenori Sato, Miyagi-ken (JP); Katsuichi Oba, Miyagi-ken (JP); Sachiko Homma, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/778,243

(22) Filed: Feb. 6, 2001

(65) Prior Publication Data

US 2001/0013463 A1 Aug. 16, 2001

(30) Foreign Application Priority Data

Feb. 10, 2000 (JP) ..... 2000-038202
Feb. 10, 2000 (JP) ..... 2000-038203

(51) Int. Cl.[7] ..... H01H 13/34
(52) U.S. Cl. ..... 200/1 B; 200/406
(58) Field of Search ..... 200/1 B, 16 D, 200/17 B, 406, 516

(56) References Cited

U.S. PATENT DOCUMENTS 4,398,070 A * 8/1983 Kondo et al. ..... 200/1 B
4,659,881 A * 4/1987 Dowe ..... 200/516 X
4,771,139 A * 9/1988 DeSmet ..... 200/516 X
5,564,560 A 10/1996 Minelli et al. ..... 200/1 B
5,726,400 A * 3/1998 Masuda ..... 200/16 D

FOREIGN PATENT DOCUMENTS

JP 1-221828 * 9/1989 ..... 200/1 B

* cited by examiner

*Primary Examiner*—Renee Luebke
(74) *Attorney, Agent, or Firm*—Brinks Hofer Gilson & Lione

(57) ABSTRACT

In a two-position pushbutton switch, a cushioning member is placed on at least one of first and second click springs, and the click spring is pressed via the cushioning member, thereby making a first press stroke long. A guide member is provided to guide the motion of a driving member. The driving member is slid along the guide member in the pressing direction of a key top.

18 Claims, 18 Drawing Sheets

TWO-POSITION PUSHBUTTON SWITCH

BACKGROUND OF THE INVENTION

1. Field of the Invention

The present invention relates to a two-position pushbutton switch suitable for use in a digital camera.

2. Description of the Related Art

A conventional two-position pushbutton switch will be described below with reference to FIGS. 32 to 35. First, second, and third switch sections S3, S4, and S5 are held in a casing 51.

The first switch section S3 is formed of a membrane switch in which an insulating sheet 54 with an opening is interposed in a folded sheet 53 having a fixed contact and a movable contact, as shown in FIG. 34.

The second switch section S4 is formed of a membrane switch in which a fixed contact formed on a sheet 52 and a movable contact formed on a sheet 53 are opposed to each other via the opening of the sheet 54.

In the casing 51, a platelike support member 55 is also placed, and an operating member 56 is mounted on the support member 55.

The operating member 56 includes a mounting portion 56*a* mounted on the support member 55, an elastic portion 56*b* connected to the mounting portion 56*a*, a projection 56*c* formed at one end of the elastic portion 56*b*, an operating portion 56*e* connected to the mounting portion 56*a* via hinge portions 56*d*, a projection 56*f* formed at the end of the operating portion 56*e*, and a projection 56*g* formed at the bottom center of the operating portion 56*e*.

The sheet 53 is bent in the shape of the letter U, and the first switch section S3 at the leading end thereof is placed on the upper surface of the operating portion 56*e*. A dome-shaped click spring 57 having a small working force and a small diameter is laid on the first switch section S3.

The second switch section S4, composed of three stacked sheets 52, 53, and 54, is placed on the upper surface of the support member 55, and a dome-shaped click spring. 58 having a great working force and a large diameter is laid on the second switch section S4 and below the projection 56*g*. The third switch section S5 is placed below the projection 56*f*.

A key top 59 includes an operating portion 59*a*, two projections 59*b* and 59*c* formed on the lower side of the operating portion 59*a*, a support portion 59*d* formed at one end of the operating portion 59*a*, and a retaining portion 59*e* formed at the other end of the operating portion 59*a*. The key top 59 is supported in a cantilevered manner at the support portion 59*d*.

When the key top 59 is mounted, the operating portion 59*a* is exposed from an opening portion 51*a* of the casing 51, the projection 59*b* is in contact with the projection 56*c* of the operating member 56, and the projection 59*c* is in contact with the click spring 57. Furthermore, the retaining portion 59*e* is retained on the inner surface of the casing 51 by the resilient force of the elastic portion 56*b* of the operating member 56.

The operation of the conventional two-position pushbutton switch will now be described. First, when the operating portion 59*a* of the key top 59 is pressed, the key top 59 tilts relative to the support portion 59*d* so as to simultaneously push the projection 56*c* and the click spring 57.

Then, the click spring 57 with a small working force is first inverted and presses the sheet 53 (folded portion) so that the movable contact is put into contact with the fixed contact thereon, thereby turning on the first switch section S3.

In this case, the relationship between the stroke A and the working force B of the key top 59 is represented by a curve C3, and the stroke A3 is short, as shown in FIG. 35.

When the key top 59 is further pressed in this state, the operating portion 56e of the operating member 56 is tilted via the hinge portions 56*d*, and therefore, the projection 56*g* of the operating portion 56e presses the click spring 58.

Subsequently, the click spring 58 with a large working force is inverted and presses the sheet 53 so that the movable contact is put into contact with the fixed contact of the sheet 52, thereby turning on the second switch section S4.

In this case, the stroke A and the working force B of the key top 59 have a relationship represented by a curve C4, as shown in FIG. 35.

In response to the tilting of the operating portion 56*e*, the projection 56*f* operates the third switch section S5 so as to switch from the ON state to an OFF state.

When the key top 59 is then released from pressing, it is pushed back by the elastic portion 56*b*, and the operating portion 56*e* is returned to its initial state by-the hinge portions 56*d*. Furthermore, the click springs 57 and 58 are inverted into their initial states because of their own resilient forces. This turns off the first and second switch sections S3 and S4, and returns the third switch section S5 into an ON state.

In a case in which such a two-position pushbutton switch is adopted-in a digital camera, focusing is performed by operating the first switch section S3 by a first press, and a shutter is released. by operating the second switch section S4 by a second press.

In the conventional two-state pushbutton switch, however, since the click spring 57 is pressed and inverted immediately after the key top 59 abuts the click spring 57, a stroke A3 of the first press is short, as shown in FIG. 35.

For this reason, when such a two-position pushbutton switch is adopted in a digital camera, the press stroke for focusing is short and the focusing operation is difficult. This decreases ease of use.

Furthermore, the operating member 56 includes the, mounting portion 56*a* and the operating portion 56*e* supported on the mounting portion 56*a* via the hinge portions 56*d*, and the operating 56*e* is able to move via the hinge portions 56*d*. This requires a large space in the lateral direction and increases the size of the switch.

SUMMARY OF THE INVENTION

Accordingly, an object of the present invention is to provide a two-position pushbutton switch in which operability is improved by extending the stroke of a key top for switching between switch sections.

Another object of the present invention is to provide a compact two-position pushbutton switch which allows smooth operation.

In order to overcome the above problems, according to an aspect of the present invention, there is provided a two-position pushbutton switch including: a first click spring to be inverted by a first working force; a first switch section to be operated by the inversion of the first click spring; a driving member disposed opposed to the first click spring so as to press the first click spring; a second switch section laid on the driving member; a second click spring to be inverted by a second working force, different from the first working force, so as to operate the second switch section; and a key top for pressing the second click spring, wherein a cushioning member is placed on at least one of the first and second click springs and the click spring is pressed via the cushioning member.

This can make a first press stroke long. For this reason, in a case in which such a two-position pushbutton switch is adopted in a digital camera, a press stroke for focusing can be made long, and the focusing operation is easy. This improves ease of use of the pushbutton switch.

The cushioning member may be placed on the second click spring.

This can make the first press stroke long. Moreover, since the key top and the second click spring are not in direct contact with each other, even when the key top rattles, no sound is produced by the contact therebetween.

The cushioning member may be placed on the first click spring.

This can make the first press stroke long. The first press stroke can be further extended by using the cushioning member in combination with a cushioning member placed on the second click spring.

Preferably, the two-position pushbutton switch further includes a casing for holding the key top, an operating portion of the key top is exposed from an opening portion of the casing, and the key top is elastically pressed against the casing and supported therein by the cushioning,member.

In this case, the cushioning member also serves to press the key top and to thereby prevent the key top from rattling. This also reduces the number of components and lowers the cost.

Preferably, the first working force for the first click spring is greater than the second working force for the second click spring.

In this case, after the second click spring at the upper position is inverted, the lower first click spring is inverted. The driving member can be stably supported by the lower click spring with a large working force.

Preferably, the diameter of the first click spring is smaller than that of the second click spring, and the thickness of the first click spring is greater than that of the second click spring.

This makes it possible to reliably make the working force for the first click spring greater than that for the second click spring and to thereby allow reliable operation.

Preferably, the first and second click springs are made of a metal leaf spring and also serve as movable contacts of the first and second switch sections.

This reduces the number of components, improves assembly efficiency, and lowers the cost.

Preferably, the two-position pushbutton switch further includes a flexible insulating substrate having fixed contacts for the first and second switch sections, and the flexible insulating substrate is bent in the shape of the letter S and is placed opposed to the first and second-click springs.

In this case, the fixed contacts can be formed in the same plane of the flexible insulating substrate, and therefore, productivity is increased.

Preferably, the two-position pushbutton switch further includes a support member for supporting the first switch section, the support member has a plurality of guide projections extending in the pressing direction of the key top, and the driving member is slid along the guide projections in the pressing direction.

This makes it possible to reduce the space for supporting the driving member and to thereby reduce the size, and to make the sliding motion of the driving member smooth.

According to another aspect of the present invention, there is provided a two-position pushbutton switch including: a first click spring to be inverted by a first working force; a first switch section to be operated by the inversion of the first click spring; a driving member placed opposed to the first click spring so as to press the first click spring; a second switch section placed on the driving member; a second click spring to be inverted by a second working force, different from the first working force, so as to operate the second switch section; a key top for pressing, the second click spring; and a guide member for guiding the motion of the driving member, wherein the driving member is slid along the guide member in the pressing direction of the key top.

Since the space for holding the driving member can be reduced, the size of the two-position pushbutton switch can also be reduced. Moreover, since the driving member can be moved stably, operability is enhanced.

Preferably, the guide member includes a plurality of guide projections arranged to surround the second switch section, and a support member is further provided so as to support the first switch section.

This reduces the size of the pushbutton switch and allows the driving member to be moved stably.

Preferably, the guide projections are shaped like a bendable column, and hook portions are formed at the leading ends of the guide projections so as to retain the driving member.

In this case, the driving member can be easily assembled and the position thereof can be regulated reliably.

The guide member may have a connecting portion for connecting the guide projections.

This facilitates assembly of the guide member and improves productivity.

Preferably, the first switch section is placed on a flexible insulating substrate, a projection is formed at the bottom of the connecting portion of the guide member, the guide member is mounted on the support member by the projection, and the flexible insulating substrate laid on the support member is sandwiched between the support member and the connecting portion.

In this case, the guide member and the flexible insulating substrate can be mounted simultaneously. This increases productivity and prevents the first switch section from lifting.

Preferably, the driving member has a flat portion for holding the second switch section thereon, and the flat portion has a plurality of guide portions to be guided by the guide projections.

This allows the driving member to be moved stably and smoothly.

Preferably, fixed contacts of the first and second switch sections are formed-on the same flexible insulating substrate, and the flexible insulating substrate is placed in a form bent in the shape of the letter S.

Since the fixed contacts can be formed on the same plane of the flexible insulating substrate, productivity is increased.

Preferably, the driving member has a pair of projecting latch portions, the flexible insulating substrate has a pair of holes, and the second switch section is held on the driving member by latching the latch portions in the holes.

In this case, the position of the second switch section with respect to the driving member can be reliably ensured, and the second switch section can be mounted without lifting.

Preferably, the first and second click springs are made of a metal leaf spring, and also function as movable contacts of the first and second switch sections.

This reduces the number of components, improves assembly efficiency, and lowers the cost.

Further objects. features, and advantages of the present invention will become apparent from the following description of the preferred embodiments with reference-to the attached drawings.

DESCRIPTION OF THE PREFERRED EMBODIMENTS

A two-position pushbutton switch according to an embodiment of the present invention will be described below with reference to the attached drawings.

The configuration of the two-position pushbutton'switch of this embodiment will now be described with reference to FIGS. 1 to 21.

A support member 1 made of a metal plate or the like has four mounting holes 1*a* formed on the outer side, and three mounting holes 1*b* formed on the inner side.

Figure 5:
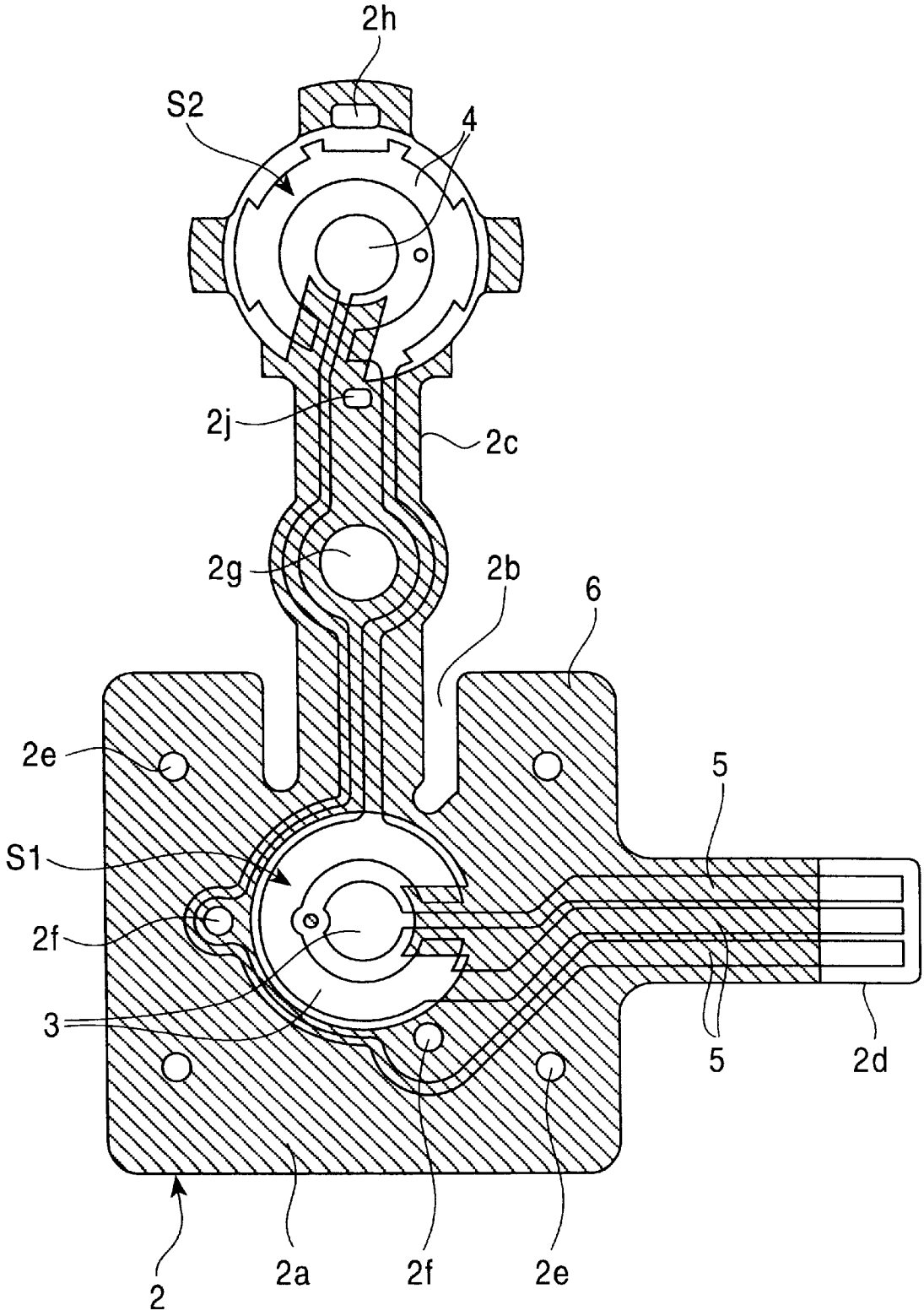
FIG. 5 is a plan view of a flexible insulating substrate in the two-position pushbutton switch.
Figure 6:
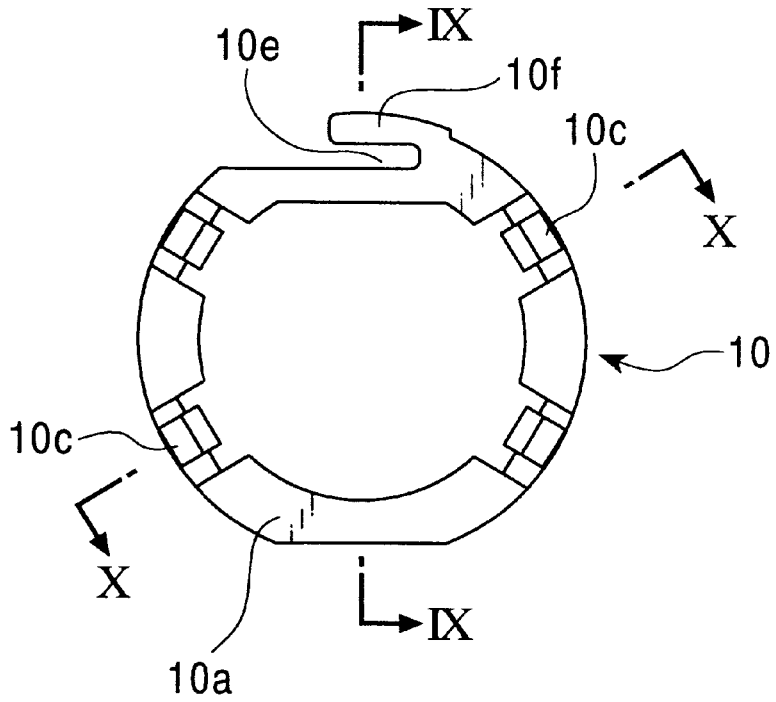
FIG. 6 is a plan view of a guide member in the two-position pushbutton switch.
Figure 7:
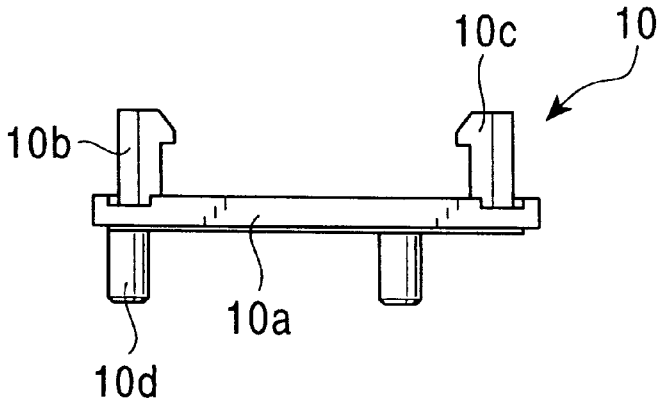
FIG. 7 is a front view of the guide member.
Figure 8:
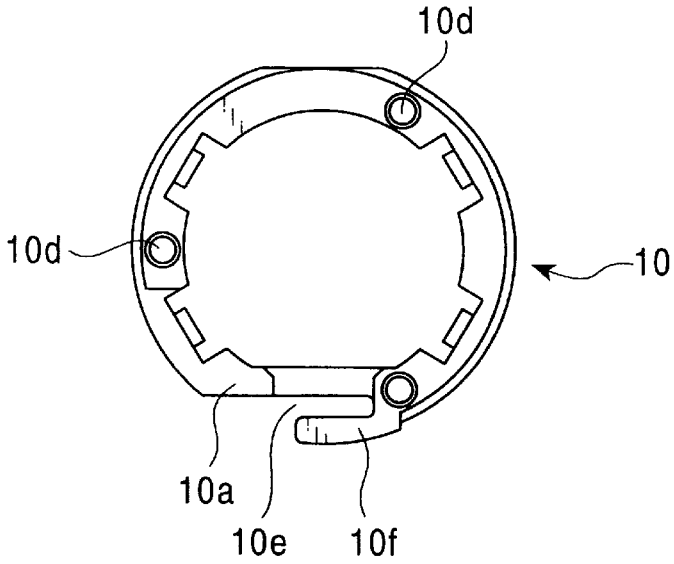
FIG. 8 is a bottom view of the guide member.
Figure 9:
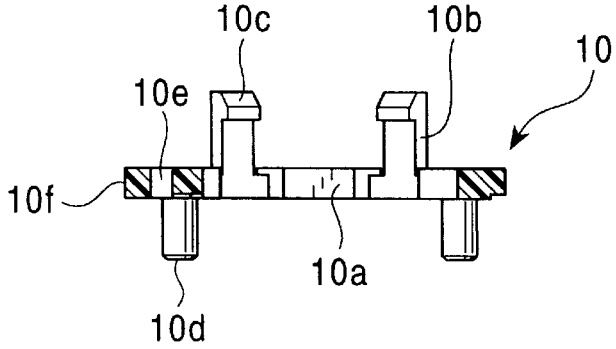
FIG. 9 is a cross-sectional view taken along line IX—IX in FIG. 6.
Figure 10:
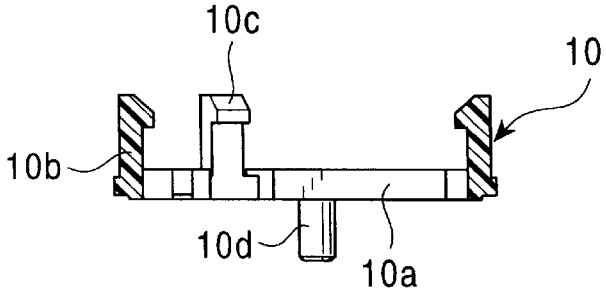
FIG. 10 is a cross-sectional view taken along line X—X in FIG. 6.
Figure 11:
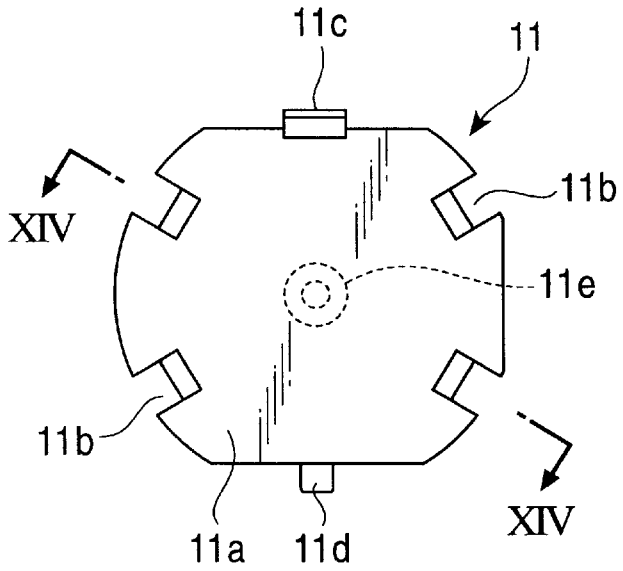
FIG. 11 is a plan view of a driving member in the two-position pushbutton switch.
Figure 12:
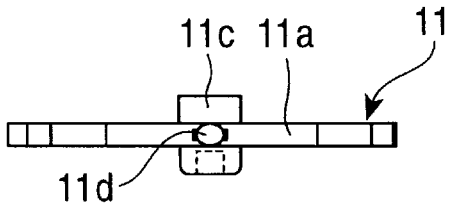
FIG. 12 is a front view of the driving member.
Figure 13:
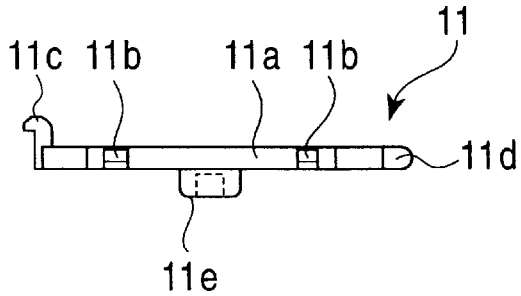
FIG. 13 is a side view of the driving member.
Figure 14:
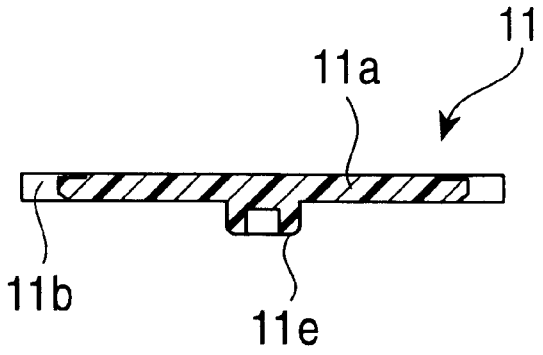
FIG. 14 is a cross-sectional view taken along line XIV—XIV in FIG. 11.
Figure 15:
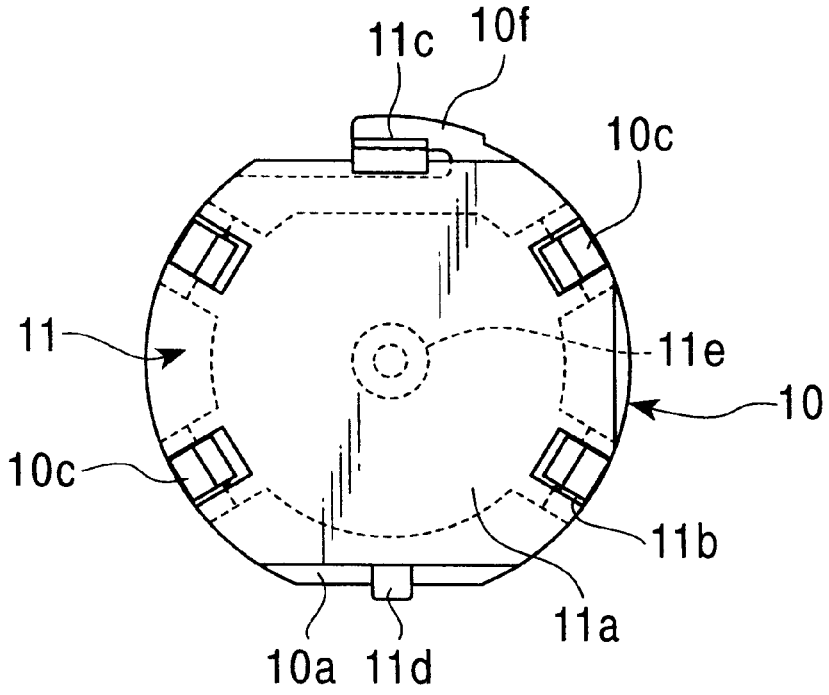
FIG. 15 is a plan view showing a state in which the guide member and the driving member are combined.
Figure 16:
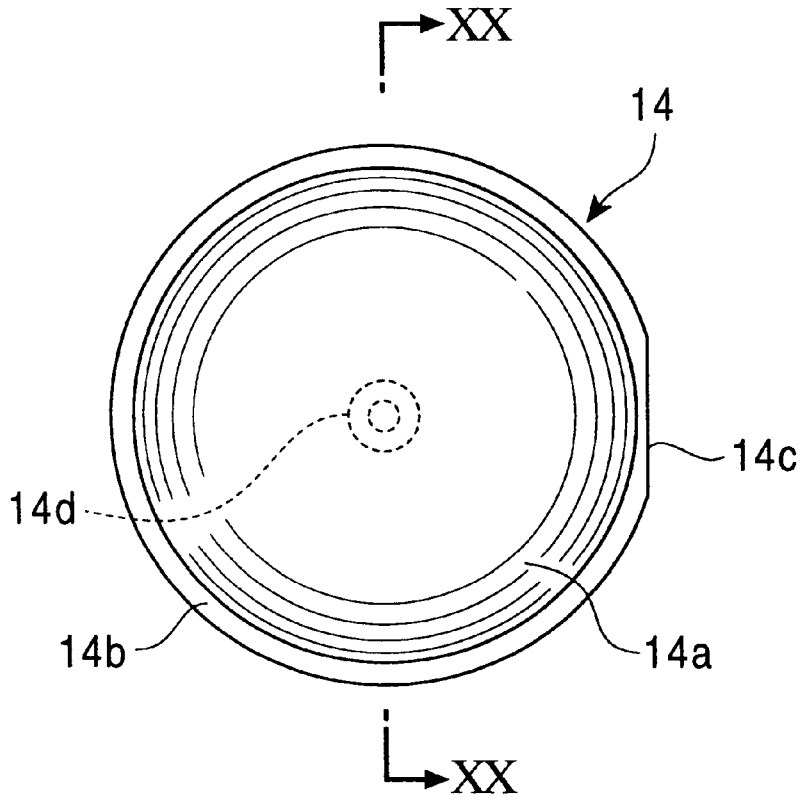
FIG. 16 is a plan view of a key top in the two-position pushbutton switch.
Figure 17:
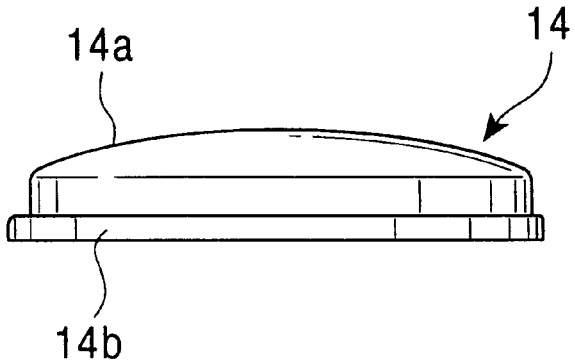
FIG. 17 is a front view of the key top.
Figure 18:
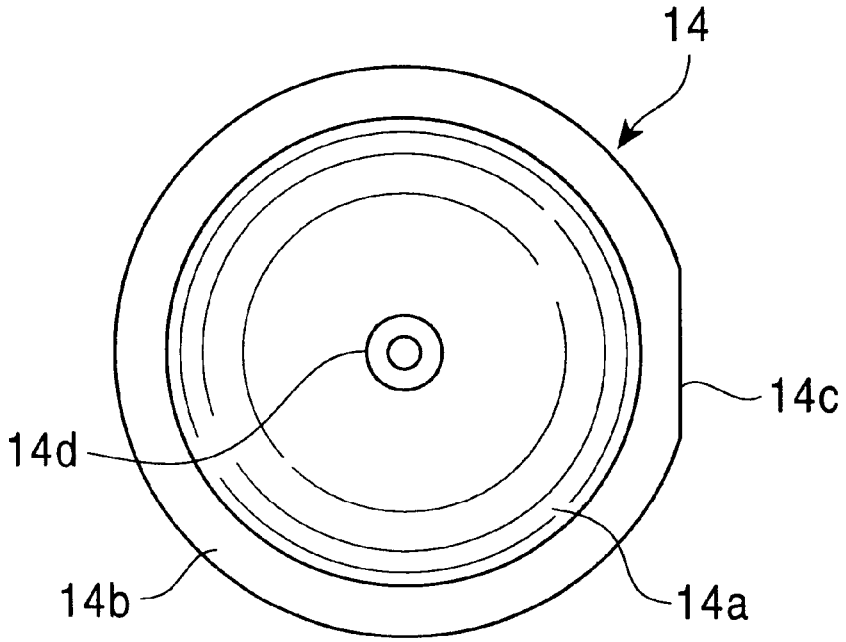
FIG. 18 is a bottom view of the key top.
Figure 19:
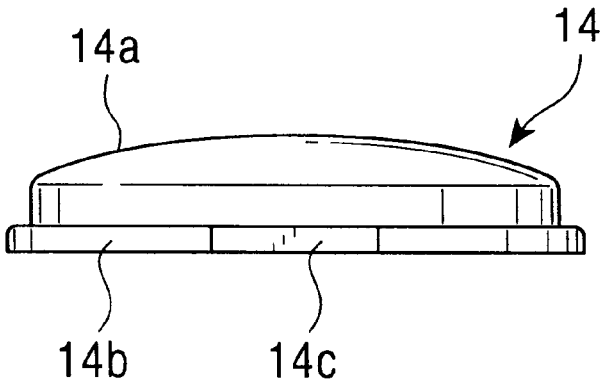
FIG. 19 is a side view of the key top.
Figure 20:
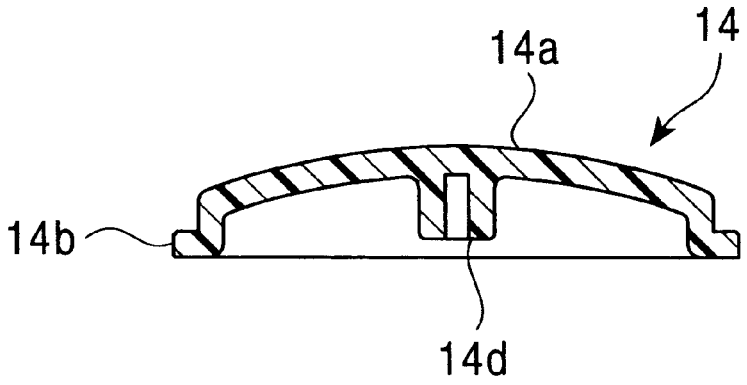
FIG. 20 is a cross-sectional view taken along line XX—XX in FIG. 16.

A flexible insulating substrate 2 made of a polyester. film includes, particularly shown in FIG. 5, a rectangular base portion 2*a*, a band portion 2*c* extending from one side of the base portion 2*a* and having cutouts 2*b* on both sides, and a band-shaped extended portion 2*d* extending from one side of the base portion 2*a* at right angles to the band portion 2*c*.

The flexible insulating substrate 2 also has four mounting holes 2*e* formed on the outer periphery of the base portion 2*a*, two mounting holes 2*f* formed inside the mounting holes 2*e*, a circular hole 2*g* formed in the center of the band portion 2*c*, and a pair of rectangular holes 2*h* and 2*j* formed at an interval in the band portion 2*c* offset from the hole 2*g* toward the leading end of the band portion 2*c*.

A conductive pattern is formed on the upper surface of the flexible insulating substrate 2 by, for example, printing conductive paste made of silver or the like. A first fixed contact 3 is formed at the center of the base portion 2*a*, and a second fixed contact 4 is formed between the holes 2*h* and 2*j* at the leading end of the band portion 2*c*. These fixed contacts 3 and 4 are led into the extended portion 2d by lead-out conductors 5. The upper surface of the flexible insulating substrate 2, excluding the first and second fixed contacts 3 and 4 and the ends of the lead-out conductors 5, is covered with an insulating resist layer 6 (hatched in FIG. 5).

A first click spring 7, which is shaped like a dome and also serves as a first movable contact, is made of a resilient leaf spring of stainless steel, and, for example, is 0.07 mm in thickness and 5 mm in diameter. The first click spring 7 is laid on the base portion 2*a* of the flexible insulating substrate 2 so that it faces the first fixed contact 3 and so that it is constantly in contact with one contact portion of the first fixed contact 3 disposed on the outer side and is spaced from the other contact portion disposed at the center.

The first click spring 7 is stuck on the flexible insulating substrate 2 with its outer surface being covered with an insulating sheet (not shown) having adhesive on one side.

The first click spring 7 and the first fixed contact 3 constitute a first switch section S1. The first click spring 7 is inverted by a substantially great working force so that the center thereof moves into contact with and apart from the center contact portion of the first fixed contact 3.

A second click spring 8 also serving as a second movable contact is made of a resilient leaf spring of stainless steel, and is shaped like a dome larger than that of the first click spring 7, for example, having a thickness of 0.05 mm and a diameter of 6 mm. The second click spring 8 is laid at the end of the band portion 2*c* of the flexible insulating substrate 2 so that it faces the second fixed contact 4 and so that it is constantly in contact with one contact portion of the second fixed contact 4 disposed on the outer side and is spaced from the other contact portion disposed at the center.

The second click spring 8 is stuck on the flexible insulating substrate 2 with its outer surface being covered with an insulating sheet (not shown) having adhesive on one side, in a manner similar to that of the first click spring 7.

The second click spring 8 and the second fixed contact 4 constitute a second switch section S2. The second click spring 8 is inverted by a working force less than that of the click spring 7 so that the center thereof moves into contact with and apart from the center contact portion of the second fixed contact 4.

Figure 1:
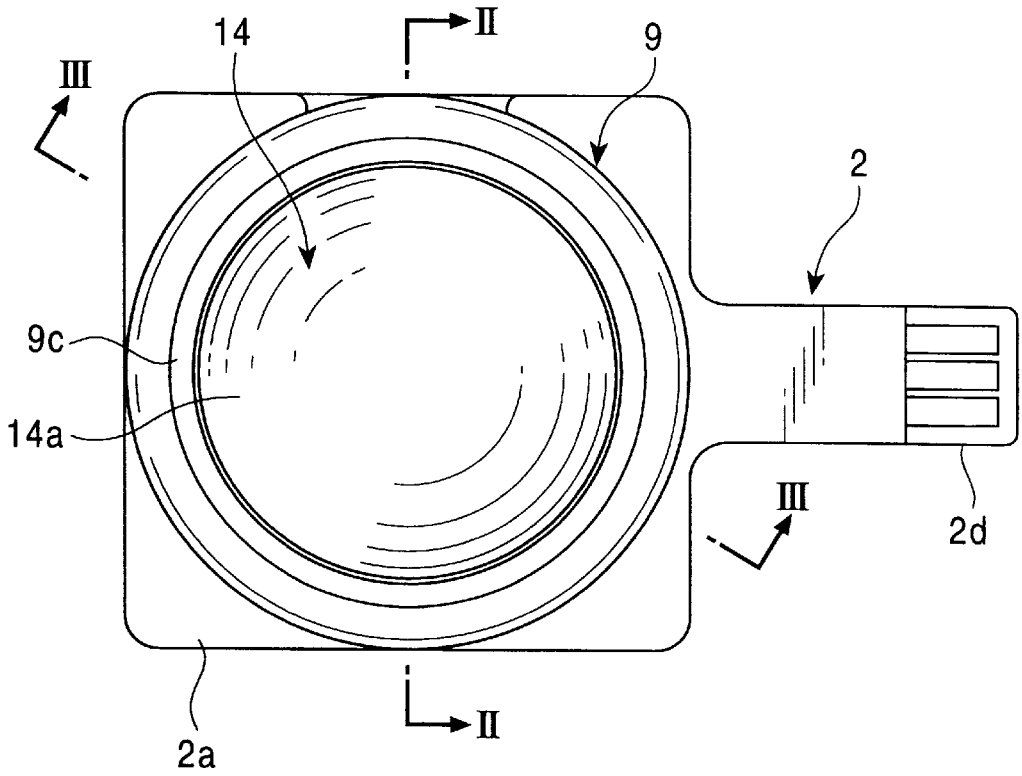
FIG. 1 is a plan view of a two-position pushbutton switch according to the present invention.
Figure 2:
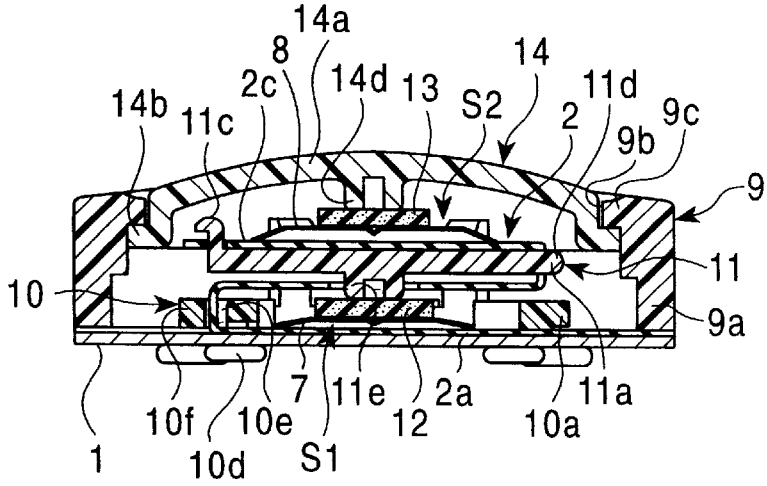
FIG. 2 is a cross-sectional view taken along line II—II in FIG. 1.
Figure 3:
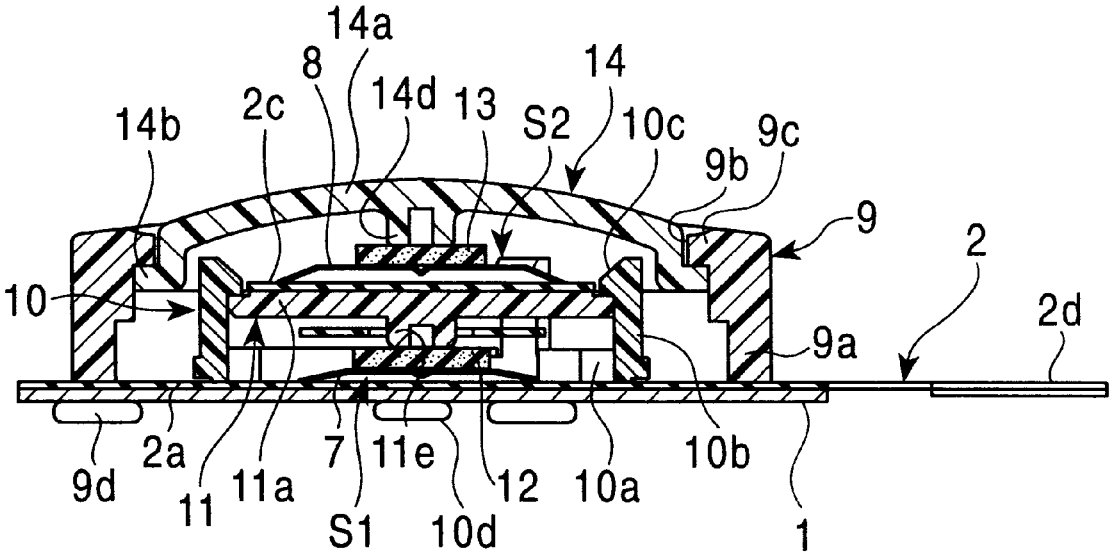
FIG. 3 is a cross-sectional view taken along line III—III in FIG. 1.
Figure 4:
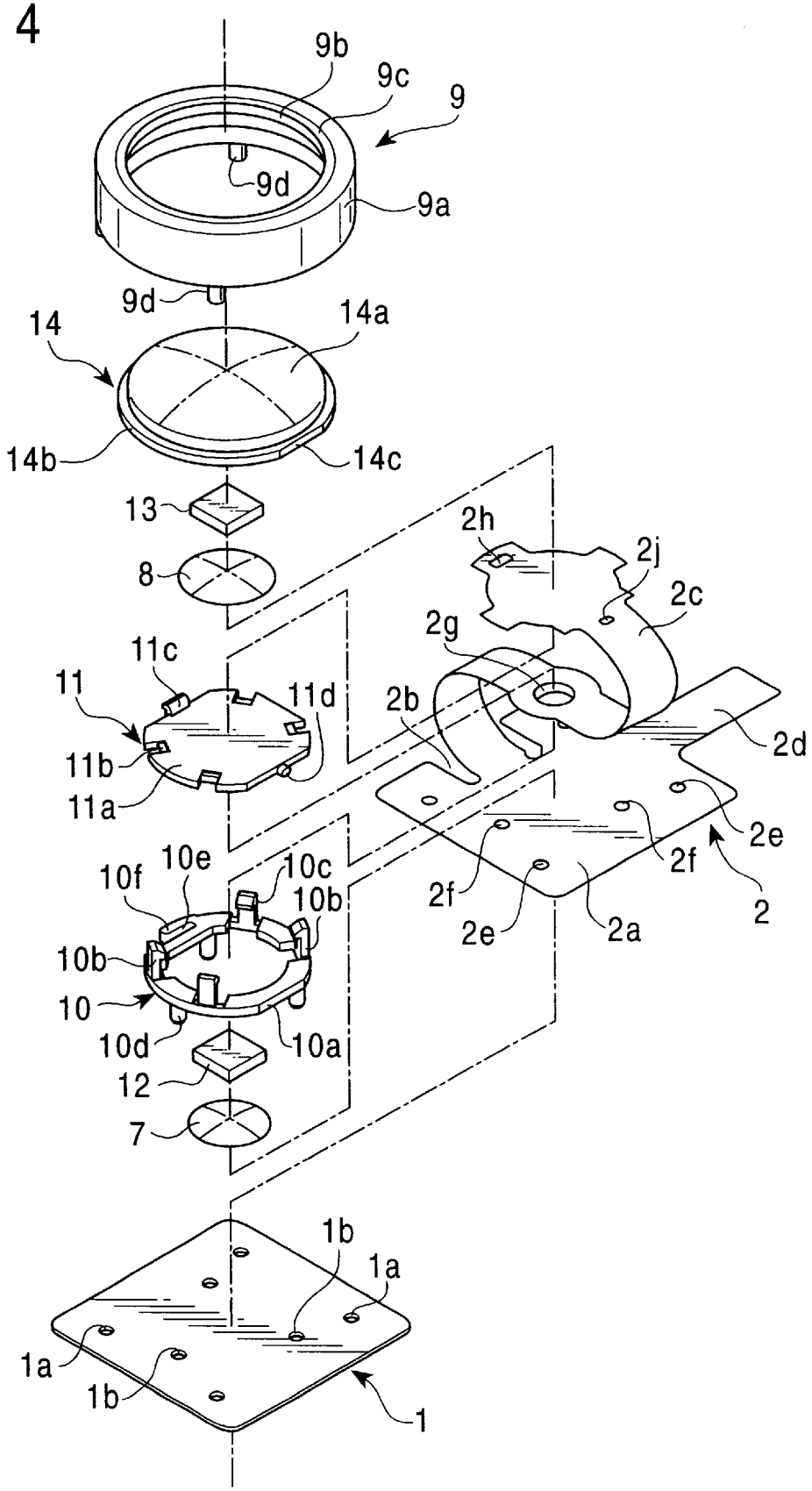
FIG. 4 is an exploded perspective view of the two-position pushbutton switch.

The base portion 2*a* of the flexible insulating substrate 2 having such a structure is placed on the support member 1 with the mounting holes 2*e* and 2*f* aligned with the mounting holes 1*a* and 1*b* of the support member 1. The band portion 2*c* is able to bend in the form of the letter S relative to the base portion 2*a*, as shown in FIGS. 2 and 4.

A casing 9 molded from synthetic resin includes a cylindrical side wall 9*a*, a flange portion 9*c* formed at the upper end of the side wall 9*a* and having a circular opening 9*b*, and four projections 9*d* projecting downward from the bottom end of the side wall 9*a*.

The casing 9 and the base portion 2*a* of the flexible insulating substrate 2 are mounted on the support member 1 by placing the bottom end of the side wall 9*a* on the flexible insulating substrate 2 with the projections 9*d* passed through the holes 1*a* and 2*e* and thermally caulking the leading ends of the projections 9*d* on the lower surface of the support member 1.

A guide member 10 molded from synthetic resin includes, particularly shown in FIGS. 6 to 10, a ring-shaped connecting portion 10*a*, a plurality of (four) bendable guide projections 10*b* projecting upward from the connecting portion 10*a*, hook portions 10*c* projecting from the upper ends of the guide projections 10*b* toward the center, three projections 10*d* projecting downward from the connecting portion 10*a*, an L-shaped support portion 10*f* projecting sideways from the connecting portion 10*a*, and a groove portion 10*e* formed between the connecting portion 10*a* and the support portion 10*f*.

The guide member 10 is mounted on the support member 1 by placing the lower side of the connecting portion 10*a* on the flexible insulating substrate 2 with the projections 10*d* passed through the mounting holes 2*f* and 1*b* and thermally caulking the leading ends of the projections 10*d* on the bottom surface of the support member 1. The base portion 2*a* of the flexible insulating substrate 2 is supported on the support member 1.

After mounting, the guide member 10 is positioned inside the casing 9, and the first switch section S1 is positioned in the center space of the connecting portion 10*a*.

Since the flexible insulating substrate 2 is pressed against the support member 1 by the connecting portion 10a of the guide member 10, the first switch section S1 will not lift.

A driving member 11 molded from synthetic resin includes, particularly shown in FIGS. 11 to 14, a flat portion 11*a*, a plurality of (four) guide portions 11*b* cut out on the outer periphery of the flat portion 11*a*, an L-shaped latch portion 11*c* formed at one end of the flat portion 11*a* so as to partly project on the upper side, a latch portion 11*d* formed on the side opposite from the latch portion 11*c* so as to project from an end face of the flat portion 11*a*, and a pressing portion lie projecting from the bottom center of the flat portion 11*a*.

The latch portion 11*c* of the driving member 11 is latched in the hole 2*h* of the flexible insulating substrate 2, and the latch portion 11*d* is latched in the hole 2*j*. The second switch section S2 disposed on the band portion 2*c* is placed on the flat portion 11*a* in a state in which the band portion 2*c* is prevented from becoming slack by the latch portions 11*c* and 11*d*.

The band portion 2*c* of the flexible insulating substrate 2 is bent along the lower side of the driving member 11, and the pressing portion 11*e* is passed through the hole 2*g*. A portion of the band portion 2*c* on the side of the base portion 2*a* is placed in the groove 10*e* of the guide member 10 and is supported by the support portion 10*f*.

The driving member 11, on which the band portion 2*c* of the flexible insulating substrate 2 is latched, is placed between guide projections 10*b* of the guide member 10*b* while the guide projections 10*b* are bent outward, and the guide projections 10*b* are then unbent and are engaged with the guide portions 11*b*.

The driving member 11 is thereby allowed to vertically move along the guide projections 10*b*. The driving member 11 is prevented from falling off upward and the position thereof is regulated by the hook portions 10c at the upper ends of the guide projections 10*b*.

When the driving member 11 is mounted, the flexible insulating substrate 2 is bent in the shape of the letter S as a whole, as shown in FIG. 2.

Since the pressing portion 11*e* of the driving member 11 is passed through the hole 2*g* of the flexible insulating substrate 2, the resilient force of the S-shaped flexible insulating substrate 2 is well balanced and the flexible insulating substrate 2 is held stably.

First and second cushioning members 12 and 13 are made of a sponge material, such as rubber sponge (soft foam rubber) or foamed polyurethane sponge (polyurethane foam), which is elastically deformed (compression-deformed) by a force less than the working force for the second click spring 8.

The first cushioning member 12 is stuck on the upper surface of the first click spring 7 (more precisely, the upper surface of the insulating sheet, which is not shown, covering the outer surface of the first click spring 7) by a double-faced adhesive tape or the like. The driving member 11 is always elastically pressed upward against the hook portions 10*c* by the first cushioning member 12. Similarly, the second cushioning member 13 is stuck on the upper surface of the second click spring 8 covered with the insulating sheet (not shown) by a double-sided adhesive tape or the like.

A key top 14 molded from synthetic resin includes, as particularly shown in FIGS. 16 to 20, an operating portion 14*a* shaped like a circular dome, a ring-shaped flange portion 14*b* projecting on the outer periphery of the operating portion 14*a*, a linear portion 14*c* formed in the flange portion 14*b*, and a pressing portion 14*d* projecting from the bottom center of the operating portion 14*a*.

The key top 14 is held inside the casing 9. The surface of the operating portion 14*a* is exposed from the opening portion 9*b*, and the flange portion 14*b* is retained and held by the inner surface of the flange portion 9*c* of the casing 9.

When the key top 14 is held in the casing 9, the linear portion 14*c* abuts a linear portion (not shown) formed in the casing 9 so as to lock the key top 14. Furthermore, the pressing portion 14*d* abuts the cushioning member 13, the key top 14 is always elastically pressed upward by the second cushioning member 13, and the flange portion 14*d* is pressed against the flange portion 9*c*, whereby the key top 14 is elastically pressed and supported so as not to rattle.

The operation of the two-position pushbutton switch of the present invention will now be described. When the operating portion 14*a* of the key top 14 is first pressed, the key top 14 is moved while elastically deforming and compressing the first and second cushioning members 12 and 13.

In this case, the second cushioning member 13 is elastically deformed and compressed by the pressing portion 14*a* of the key top 14, and the first cushioning member 12 is elastically deformed and compressed by the pressing portion 11*e* of the driving member 11 which is pressed by the key top 14 and is slid along the guide member 10.

When the pressing of the key top 14 is continued, the first and second cushioning members 12 and 13 are further deformed elastically. When the elastic depression exceeds the limit, the second cushioning member 13 presses and inverts the second click spring 8 with a small working force. Then, the second click spring 8 turns on the second switch section S2.

Figure 21:
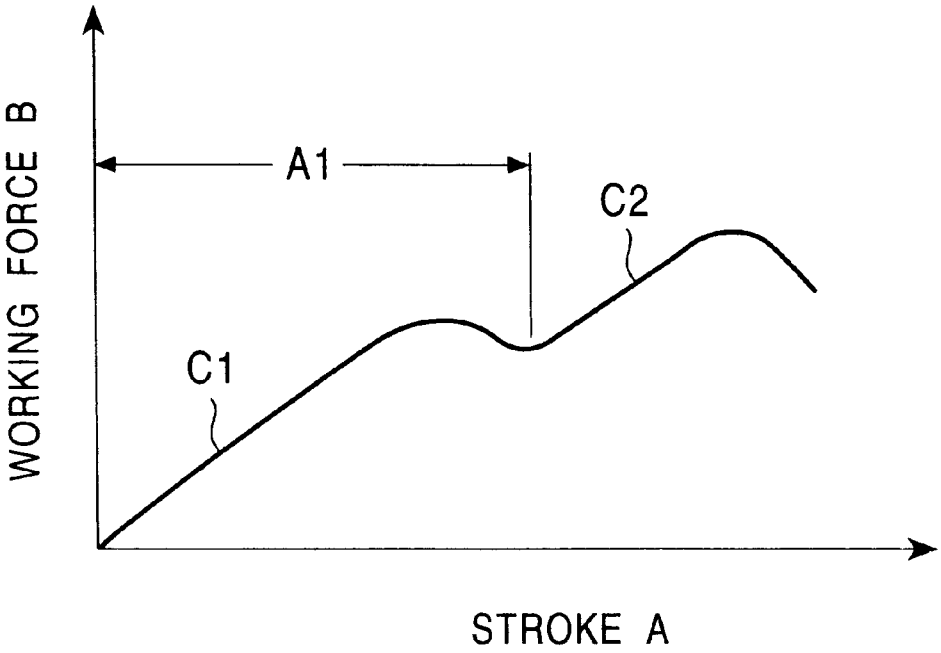
FIG. 21 is a graph showing the relationship between the stroke and the working force in the two-position pushbutton switch.
Figure 22:
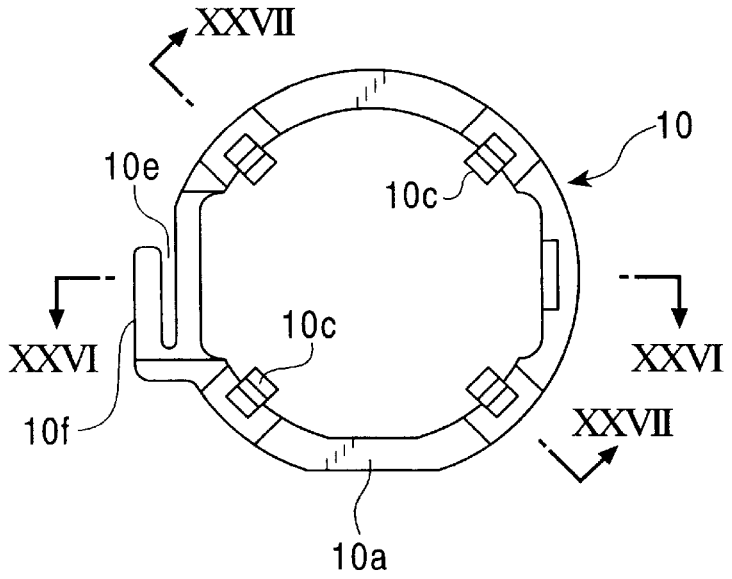
FIG. 22 is a plan view of another example of a guide member.
Figure 23:
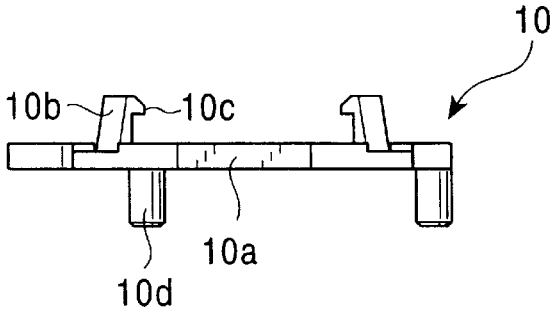
FIG. 23 is a front view of the guide member.
Figure 24:
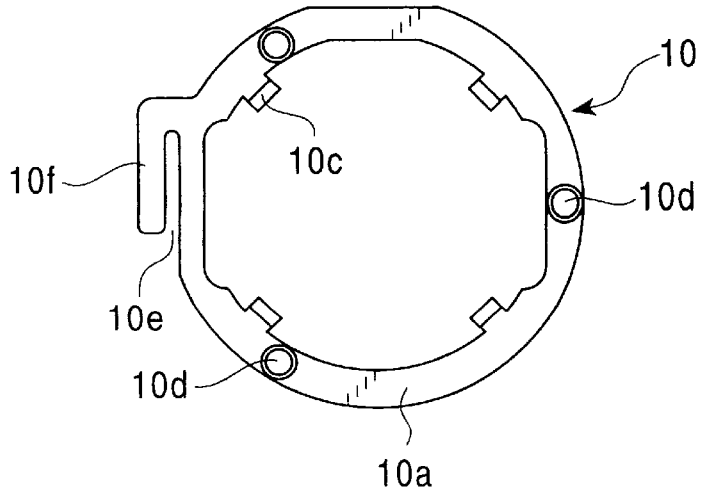
FIG. 24 is a bottom view of the guide member.
Figure 25:
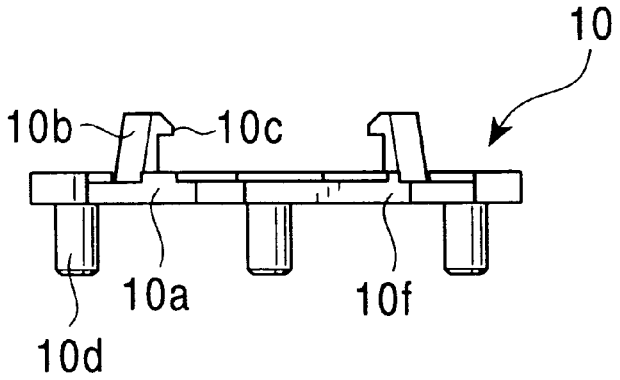
FIG. 25 is a side view of the guide member.
Figure 26:
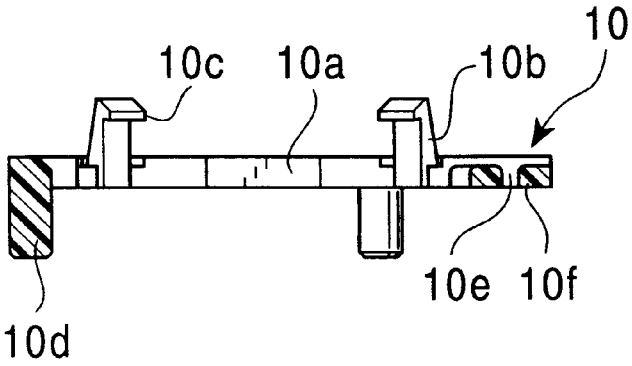
FIG. 26 is a cross-sectional view taken along line XXVI—XXVI in FIG. 22.
Figure 27:
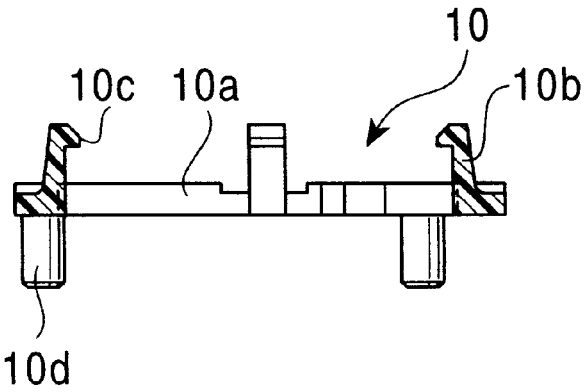
FIG. 27 is a cross-sectional view taken along line XXVII—XXVII in FIG. 22.
Figure 28:
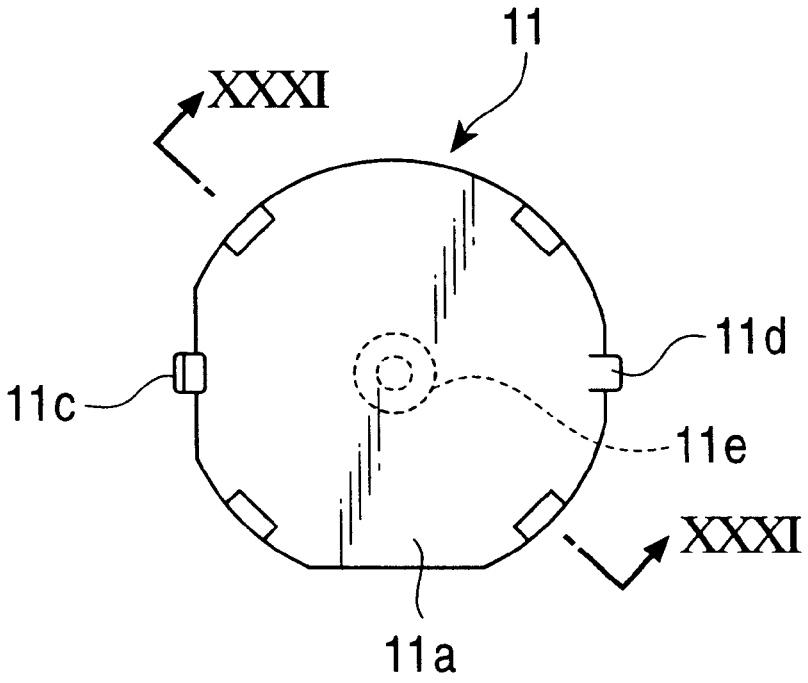
FIG. 28 is a plan view of another example of a driving member.
Figure 29:
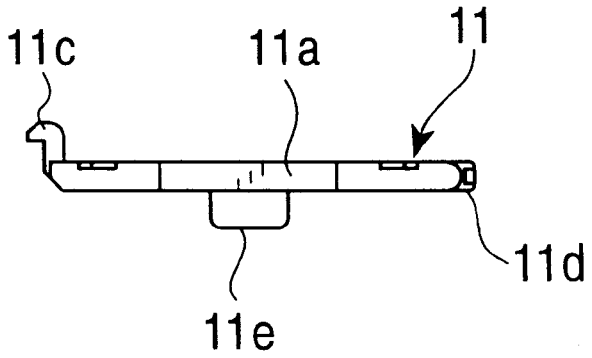
FIG. 29 is a front view of the driving member.
Figure 30:
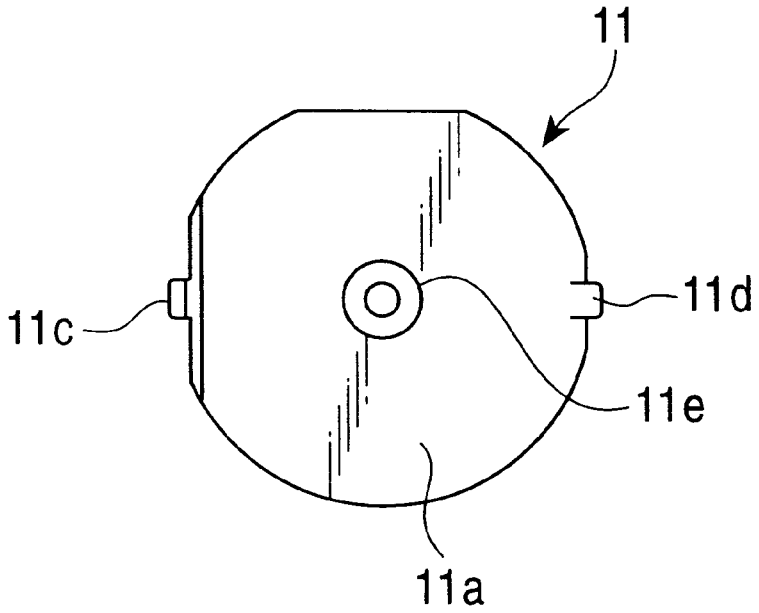
FIG. 30 is a bottom view of the driving member.
Figure 31:
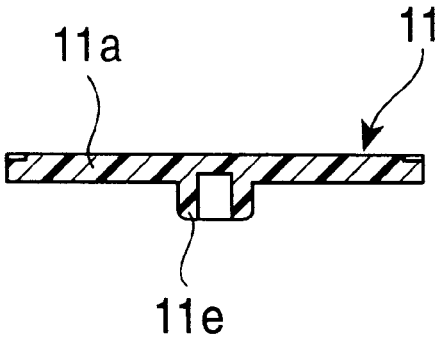
FIG. 31 is a cross-sectional view taken along line XXXI—XXXI in FIG. 28.
Figure 32:
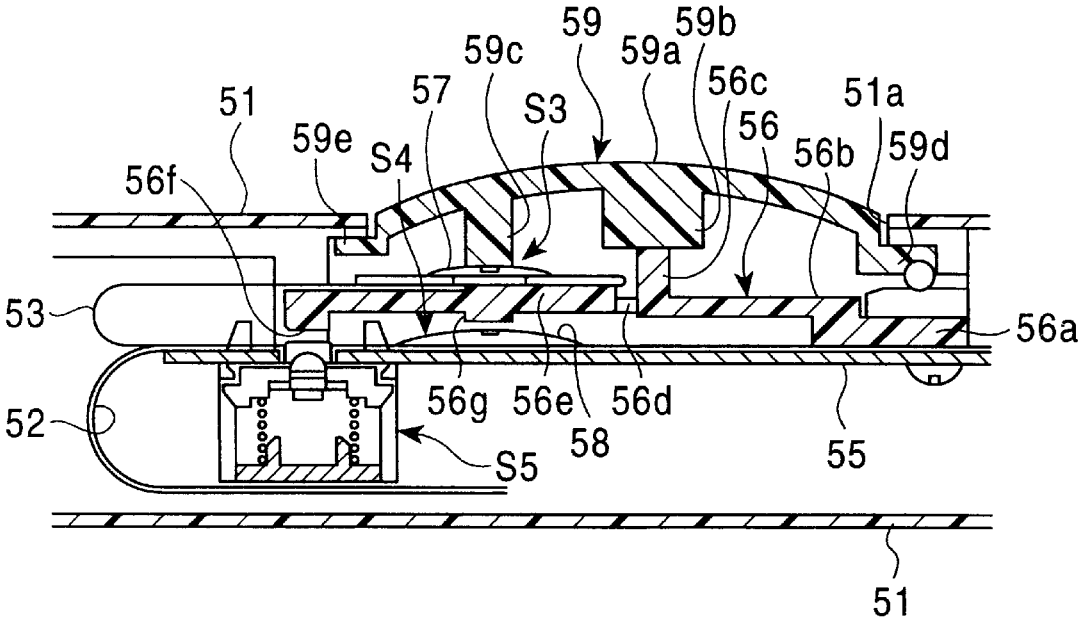
FIG. 32 PRIOR ART
FIG. 32 is a cross-sectional view of a conventional two-position pushbutton switch.
Figure 33:
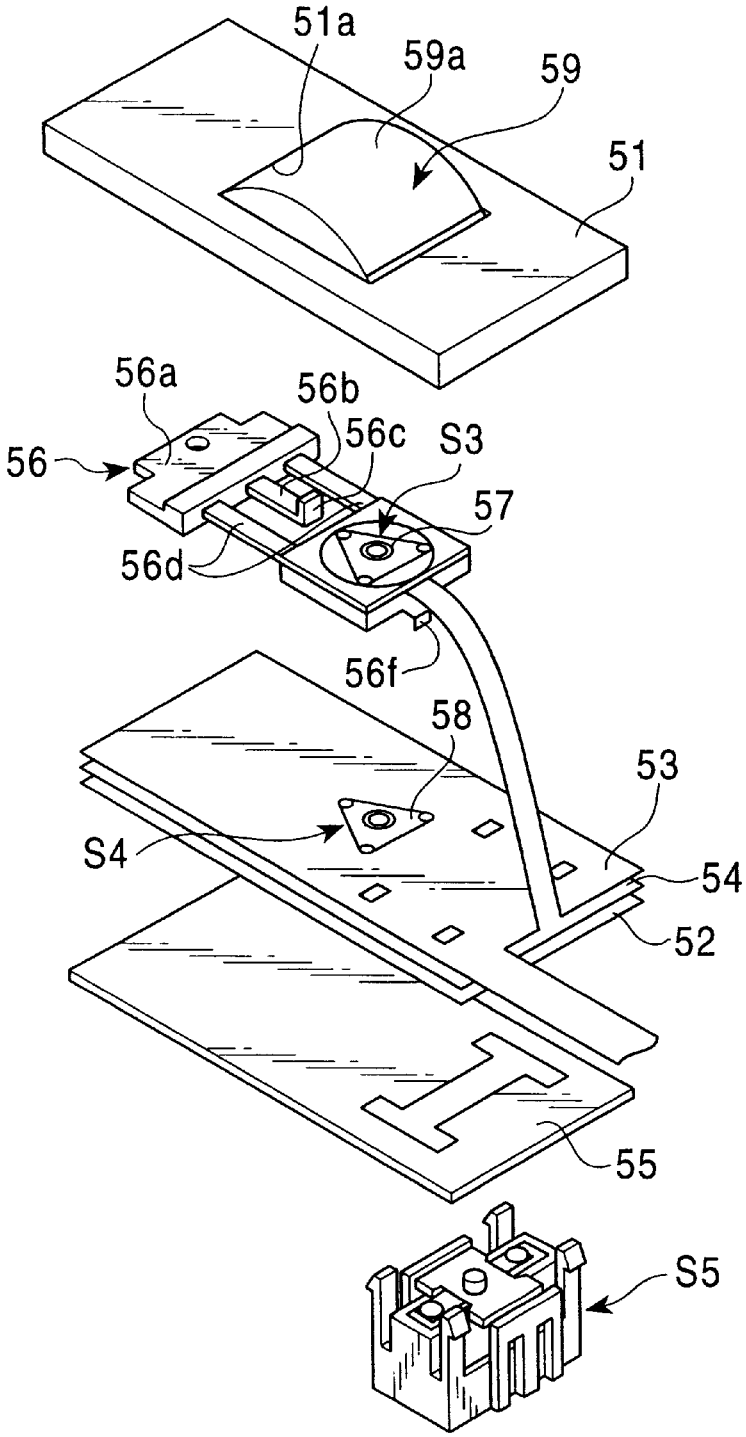
FIG. 33 PRIOR ART
FIG. 33 is an exploded perspective view of the conventional two-position pushbutton switch.
Figure 34:
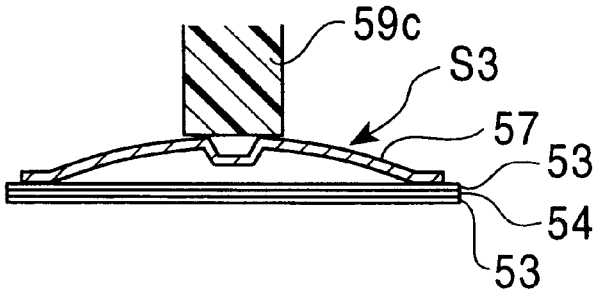
FIG. 34 PRIOR ART
FIG. 34 is a cross-sectional view showing the principal part of a first switch section in the conventional two-position pushbutton switch.
Figure 35:
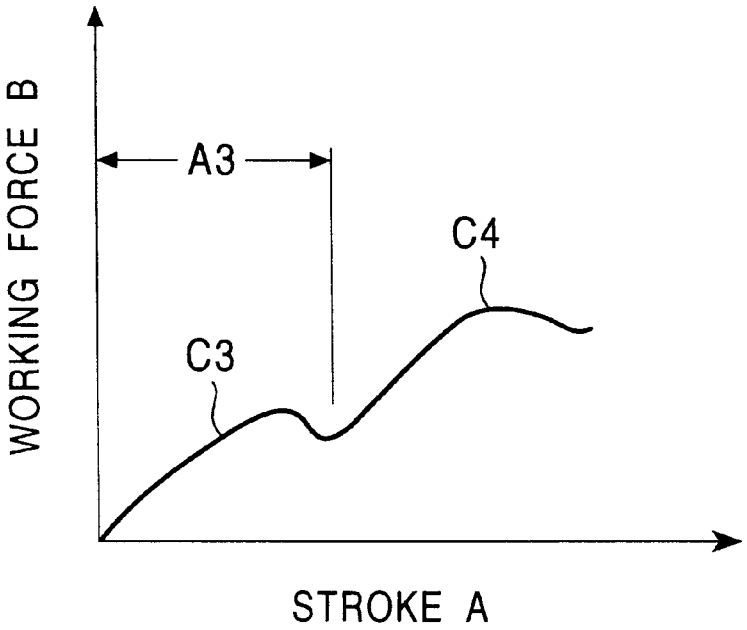
FIG. 35 PRIOR ART
FIG. 35 is a graph showing the relationship between the stroke and the working force in the conventional two-position. pushbutton switch.

In this case, as shown in FIG. 21, a stroke A of the key top 14 and a working force B (force to be applied to the key top 14) have a relationship represented by a smooth curve C1, and a stroke A1 thereof is long.

When the key top 14 is further pressed in this state, the driving member 11 is moved along the guide member 10 in the pressing direction, and the first click spring 7 is pressed by the first cushioning member 12.

Next, the first click spring 7 having a large working force is inverted to turn on the first switch section S1.

In this case, the stroke A and the working force B of the key top 14 have a relationship represented by a curve C2, as shown in FIG. 21.

When the pressing force is removed from the key top 14, the first and-second click springs 7 and 8 are inverted to their initial states because of their own resilient forces, and the first and second switch sections S1 and S2 are turned off. Furthermore, the first cushioning member 12 is elastically returned, and the driving member 11 is thereby returned upward into the initial state retained by the hook portions 10*c*. The second cushioning member 13 is elastically returned, the key top 14 is returned upward, and the flange portion 14*b* is elastically pressed against the flange portion 9*c*.

The two-position pushbutton switch of the present invention is operated in this way.

In a case in which such a two-position pushbutton switch of the present invention is adopted in a digital camera, the second switch section S2 is operated by a first press so as to perform focusing, and the first switch section S1 is operated by a second press so as to release the shutter.

In such a two-position pushbutton switch of the present invention, when the key top 14 is pressed, a relatively long stroke having a desired working force (elastic force) is first obtained by the cushioning members 12 and 13. Next, the long stroke A1 is obtained as a whole by inverting the second click spring 8 by the first press.

When the cushioning member 12 and 13 are compressed, a force equivalent to the load (working force) applied to the operating portion 14*a* of the key top 14 acts on the second click spring 8. Therefore, the curve C1 is continuous and smooth. This allows a comfortable operation feeling in the first press.

For this reason, the press stroke is long at the time of focusing, and this facilitates the focusing operation and improves operability.

FIGS. 22 to 27 show another example of a guide member 10. While the connecting portion 11*a* of the guide member 10 in the above embodiment is wide, a connecting portion 10*a* of this example is made narrow in order to reduce the outer size.

Since other structures are similar to those in the above embodiment, the same components are denoted by the same numerals, and descriptions thereof are omitted.

FIGS. 28 to 31 show another example of a driving member 11. While the driving member 11 in the above embodiment has the cut-out guide portions 11*b*, the guide member 11 of this example has no guide portions in order to reduce the outer size.

Since other structures are similar to those in the above embodiment, the same components are denoted by the same numerals, and descriptions thereof are omitted.

The guide member 10 shown in FIGS. 22 to 27 is used in combination with the driving member 11 shown in FIGS. 28 to 31. The driving member 11 is supported on the flexible insulating substrate 2 so that it barely rotates and it slides in the pressing direction of the key top 14 with the outer periphery of a flat portion 11*a* thereof being guided by a plurality of guide projections 10*b*.

While the first and second cushioning members 12 and 13 are adopted in the above embodiment, only one of them may be used. In a case in which only the first cushioning member 12 is used, first, the driving member 11 is slid by pressing the key top 14. The driving member 11 elastically deforms and compresses the first cushioning member 12 and then inverts the second click spring 8 with a small working force. In contrast, in a case in which only the second cushioning member 13 is used, it is elastically deformed and compresses by pressing the key top 14, and the second click spring 8 with a small working force is then inverted.

While. the first and second click springs 7 and 8 also function as movable contacts in the above embodiment, they need not always serve the function. The switch sections S1 and S2 may be formed of so-called membrane switches in which. contacts are formed opposed to each other on a film substrate, and may be operated by the inversion of the first and second click springs 7 and 8.

While the guide projections 10*b* of the guide member 10 are connected by the connecting portion 10*a* in the above embodiment, the guide member 10 may have guide projections formed independently. Furthermore, the number of the guide projections 10*b* is not limited to four and may be two as long as the guide projections 10*b* are shaped like a circular arc.

While the guide portions 11*b* of the driving member 11 are cut out in the above embodiment, they may be formed of holes or outer end portions of the driving member 11.

While the key top 14 is inserted in the opening portion 9*b* of the casing 9 and the pressing portion 14*d* thereof is held on the second cushioning member 13 in the above embodiment, various holding structures may, of course, be, adopted. For example, the key top 14 may have an elastically deformable hinged portion which is fixed to the inner surface of the casing 9.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A two-position pushbutton switch comprising:

a first click spring to be inverted by a first working force;

a first switch section to be operated by inversion of said first click spring;

a driving member having a flat portion that opposes and presses said first click spring;

a second switch section laid on a surface of the flat portion of said driving member;

a second click spring to be inverted by a second working force, different from the first working force, so as to operate said second switch section; and a key top for pressing said second click spring, wherein a cushioning member is placed on at least one of said first and second click springs and said at least one of said first and said second click spring is pressed via said cushioning member, and wherein a surface area of the flat portion of the driving member is at least as large as a surface area of the first and second click springs.

2. A two-position pushbutton switch according to claim 1, wherein said cushioning member is placed on said second click spring.

3. A two-position pushbutton switch according to claim 1, wherein said cushioning member is placed on said first click spring.

4. A two-position pushbutton switch according to claim 1, further comprising:

a casing for holding said key top, wherein an operating portion of said key top is exposed from an opening portion of said casing, and said key top is elastically pressed against said casing and supported therein by said cushioning member.

5. A two-position pushbutton switch according to claim 1, wherein the first working force for said first click spring is greater than the second working force for said second click spring.

6. A two-position pushbutton switch according to claim 5, wherein a diameter of said first click spring is smaller than that of said second click spring, and a thickness of said first click spring is greater than that of said second click spring.

7. A two-position pushbutton switch according to claim 1, wherein said first and second click springs are made of a metal leaf spring and also serve as movable contacts of said first and second switch sections.

8. A two-position pushbutton switch according to claim 1, further comprising:

a flexible insulating substrate having fixed contacts for said first and second switch sections, wherein said flexible insulating substrate is bent in the shape-of the letter S and is placed opposed to said first and second click springs.

9. A two-position pushbutton switch according to claim 1, further comprising:

a support member for supporting said first switch section, wherein said support member has a plurality of guide projections extending in a pressing direction of said key top, and said driving member is slid along said guide projections in the pressing direction.

10. A two-position pushbutton switch comprising:

a first click spring to be inverted by a first working force;

a first switch section to be operated by the inversion of said first click spring;

a driving member having a flat portion that opposes and presses said first click spring;

a second switch section placed on a surface of the flat portion of said driving member;

a second click spring to be inverted by a second working force, different from the first working force, so as to operate said second switch section;

a key top for pressing said second click spring; and a guide member for guiding a motion of said driving member, wherein said driving member is slid along said guide member in a pressing direction of said key top, wherein a surface area of the flat portion of the driving member is at least as large as a surface area of the first and second click springs.

11. A two-position pushbutton switch according to claim 10, wherein said guide member includes a plurality of guide projections arranged to surround said second switch section, and a support member is further provided so as to support said first-switch section.

12. A two-position pushbutton switch according to claim 11, wherein said guide projections are shaped like a bendable column, and hook portion are formed at leading ends of said guide projections so as to retain said driving member.

13. A two-position pushbutton switch according to claim 11, wherein said guide member has a connecting portion for connecting said guide projections.

14. A two-position pushbutton switch according to claim 13, wherein said first switch section is placed on a flexible insulating substrate, a projection is formed at a bottom of said connecting portion of said guide member, said guide member is mounted on said support member by said projection, and said flexible insulating substrate laid on said support member is sandwiched between said support member and said connecting portion.

15. A two-position pushbutton switch according to claim 11, wherein said driving member has a flat portion for holding said second switch section thereon, and said flat portion has a plurality of guide portions to be guided by said guide projections.

16. A two-position pushbutton switch according to claim 10, wherein fixed contacts of said first and second switch sections are formed on a flexible insulating substrate, and said flexible insulating substrate is placed in a form bent in the shape of the letter S.

17. A two-position pushbutton switch according to claim 16, wherein said driving member has a pair of projecting latch portions, said flexible insulating substrate has a pair of holes, and said second switch section is held on said driving member by latching said latch portions in said holes.

18. A two-position pushbutton switch according to claim 10, wherein said first and second click springs are made of a metal leaf spring, and also function as movable contacts of said first and second switch sections.

* * * * *

UNITED STATES PATENT AND TRADEMARK OFFICE

CERTIFICATE OF CORRECTION

PATENT NO. : 6,492,602 B2
DATED : December 10, 2002
INVENTOR(S) : Akira Asai et al.

It is certified that error appears in the above-identified patent and that said Letters Patent is hereby corrected as shown below:

Column 11,
Line 64, delete “shape-of” and substitute -- shape of -- in its place.

Column 12,
Line 29, delete “first-switch” and substitute -- first switch -- in its place.
Line 32, delete “portion” and substitute -- portions -- in its place.

Signed and Sealed this

Eighteenth Day of March, 2003

JAMES E. ROGAN
*Director of the United States Patent and Trademark Office*